US007810360B2

(12) United States Patent
Kim et al.

(10) Patent No.: US 7,810,360 B2
(45) Date of Patent: Oct. 12, 2010

(54) DEODORIZATION APPARATUS AND WASHING MACHINE HAVING THE SAME

(75) Inventors: Kyeong Hwan Kim, Seoul (KR); Myong-Hun Im, Gwangmyeong (KR); Kyung-Chul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 726 days.

(21) Appl. No.: 11/715,399

(22) Filed: Mar. 8, 2007

(65) Prior Publication Data

US 2008/0078209 A1 Apr. 3, 2008

(30) Foreign Application Priority Data

Oct. 2, 2006 (KR) ..... 10-2006-0097447

(51) Int. Cl.
*D06F 18/00* (2006.01)

(52) U.S. Cl. ..... 68/3 R; 68/20

(58) Field of Classification Search ..... 68/3 R, 68/20

See application file for complete search history.

(56) References Cited

U.S. PATENT DOCUMENTS

| | | | | |
|---|---|---|---|---|
| 2,434,476 | A * | 1/1948 | Wales | 68/19.2 |
| 2,608,003 | A * | 8/1952 | Tucker | 34/88 |
| 2,670,549 | A * | 3/1954 | O'Neil | 34/131 |
| 2,798,302 | A * | 7/1957 | Reiter | 34/543 |
| 2,807,889 | A * | 10/1957 | Dunkelman | 34/546 |
| 2,807,893 | A * | 10/1957 | Morey | 34/597 |
| 2,818,719 | A * | 1/1958 | Cline | 68/19.2 |
| 2,957,330 | A * | 10/1960 | Cline | 68/20 |
| 3,059,203 | A * | 10/1962 | Hetrick | 439/27 |
| 3,531,954 | A * | 10/1970 | Krupsky | 68/18 F |
| 4,418,398 | A * | 11/1983 | Hornung | 713/100 |
| 4,489,574 | A * | 12/1984 | Spendel | 68/16 |
| 5,050,259 | A * | 9/1991 | Tsubaki et al. | 8/159 |
| 5,107,606 | A * | 4/1992 | Tsubaki et al. | 34/596 |
| 5,524,358 | A * | 6/1996 | Matz | 34/275 |
| 5,887,456 | A * | 3/1999 | Tanigawa et al. | 68/20 |
| 6,000,248 | A * | 12/1999 | Erickson et al. | 68/17 R |
| 7,434,333 | B2 * | 10/2008 | Yang et al. | 34/603 |
| 7,481,083 | B2 * | 1/2009 | Habu et al. | 68/19.2 |
| 2005/0241345 | A1 * | 11/2005 | Park et al. | 68/15 |

FOREIGN PATENT DOCUMENTS

| | | |
|---|---|---|
| CN | 1566498 | 1/2005 |

(Continued)

OTHER PUBLICATIONS

European Patent Office 0 666 355 Aug. 1995.*

(Continued)

*Primary Examiner*—Frankie L Stinson
(74) *Attorney, Agent, or Firm*—McKenna Long & Aldridge LLP

(57) ABSTRACT

A deodorization apparatus and a washing machine having the same are provided. The washing machine having the deodorization apparatus includes a tub including a ventilator, and a deodorization apparatus disposed outside the tub, having one side that communicates with the tub, and removing an laundry odor by injecting air into the tub. Therefore, the laundry odor can be quickly removed, and water and power consumption and damage to the laundry, which are caused by a washing operation using the water for deodorization of the laundry, can be prevented.

16 Claims, 8 Drawing Sheets

FOREIGN PATENT DOCUMENTS

| | | | |
|---|---|---|---|
| CN | 1769573 | | 5/2006 |
| CN | 1773004 | | 5/2006 |
| DE | 198 12 363 | * | 7/1999 |
| JP | 59-014891 | * | 1/1984 |
| JP | 59-209399 | * | 11/1984 |
| JP | 2002-336590 | * | 11/2002 |
| JP | 2004-350984 | * | 12/2004 |
| JP | 2005-000492 | * | 1/2005 |
| JP | 3625820 | * | 12/2006 |

OTHER PUBLICATIONS

European Patent Office 0 816 548 Jun. 1996.*

* cited by examiner

DEODORIZATION APPARATUS AND WASHING MACHINE HAVING THE SAME

This application claims the benefit of Korean Application No. 10-2006-0097447, filed on Oct. 2, 2006, which is hereby incorporated by reference for all purposes as if fully set forth herein.

BACKGROUND OF THE INVENTION

1. Field of the Invention

The present invention relates to a deodorization apparatus and a washing machine having the same, and more particularly, to a deodorization apparatus and a washing machine having the same that can quickly remove odor from laundry by contacting the laundry with outside air.

2. Discussion of the Related Art

In general, a washing machine includes a tub that accommodates water therein and a washing tub that is rotatably provided inside the tub. The washing machine receives laundry in the washing tub and water and detergent in the tub so as to remove dirt in the laundry by the operation of the water and the detergent.

As shown in FIG. 1, a washing machine includes a cabinet 11, a tub 21 that is received in the cabinet 11, and a washing tub 31 that is rotatably provided in the tub 21.

An opening 12 and a door 13 are provided on a front surface of the cabinet 11 such that the laundry can be put in and taken out of the washing tub. In the cabinet 11, the tub 21 is supported by a spring 22 and a damper 23.

The tub 21 has a cylindrical shape with one side thereof open. The washing tub 31 is rotatably provided in the tub 21. The washing tub 31 has a cylindrical shape with one side thereof open. Further, a plurality of through holes 33 are formed on a circumferential surface of the washing tub 31. A plurality of lifts 35 are provided in the washing tub 32 so as to lift the laundry.

Meanwhile, a driving motor 25 is coupled to a rear end portion of the tub 21 so as to rotate the washing tub 31. A drain path 27 that includes a drain pump 28 is provided at a lower part of the washing tub 31 so as to drain water.

A detergent dispenser 41 is provided above the tub 21 so as to supply detergent. A water supply pipe 43 is connected to the detergent dispenser 41. A water supply valve 45 is provided on the water supply pipe 43.

However, in the washing machine according to the related art, wash, rinse, and/or spin drying is performed according to a selected operating mode. Even after the odor of the laundry is removed, the laundry continues to be washed using water. Therefore, water and power are wasted and the lifespan of the laundry is decreased.

SUMMARY OF THE INVENTION

Accordingly, the present invention is directed to a deodorization apparatus and washing machine having the same that substantially obviates one or more of the problems due to limitations and disadvantages of the related art.

An advantage of the present invention is to provide a deodorization apparatus and a washing machine having the same, capable of quickly removing an odor from laundry.

Another advantage of the present invention is to provide a deodorization apparatus and a washing machine having the same, capable of preventing a decreased laundry lifespan, which is caused by performing a washing operation, and reducing the amount of water consumed for deodorization.

To achieve these and other advantages and in accordance with the purpose of the present invention, as embodied and broadly described herein, there is provided a washing machine having a deodorization apparatus that includes a cabinet, a tub including ventilator, and a deodorization apparatus disposed outside the tub, having one side that communicates with the tub, and removes laundry odor by injecting air into the tub.

In another aspect of the present invention, there is provided a deodorization apparatus that includes a case including an intake hole and a discharge hole, a fan disposed in the case, a heater disposed in the case, and a connecting pipe connected to at least one of the intake hole and the discharge hole, wherein the deodorization apparatus is installed in a washing machine.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 1:
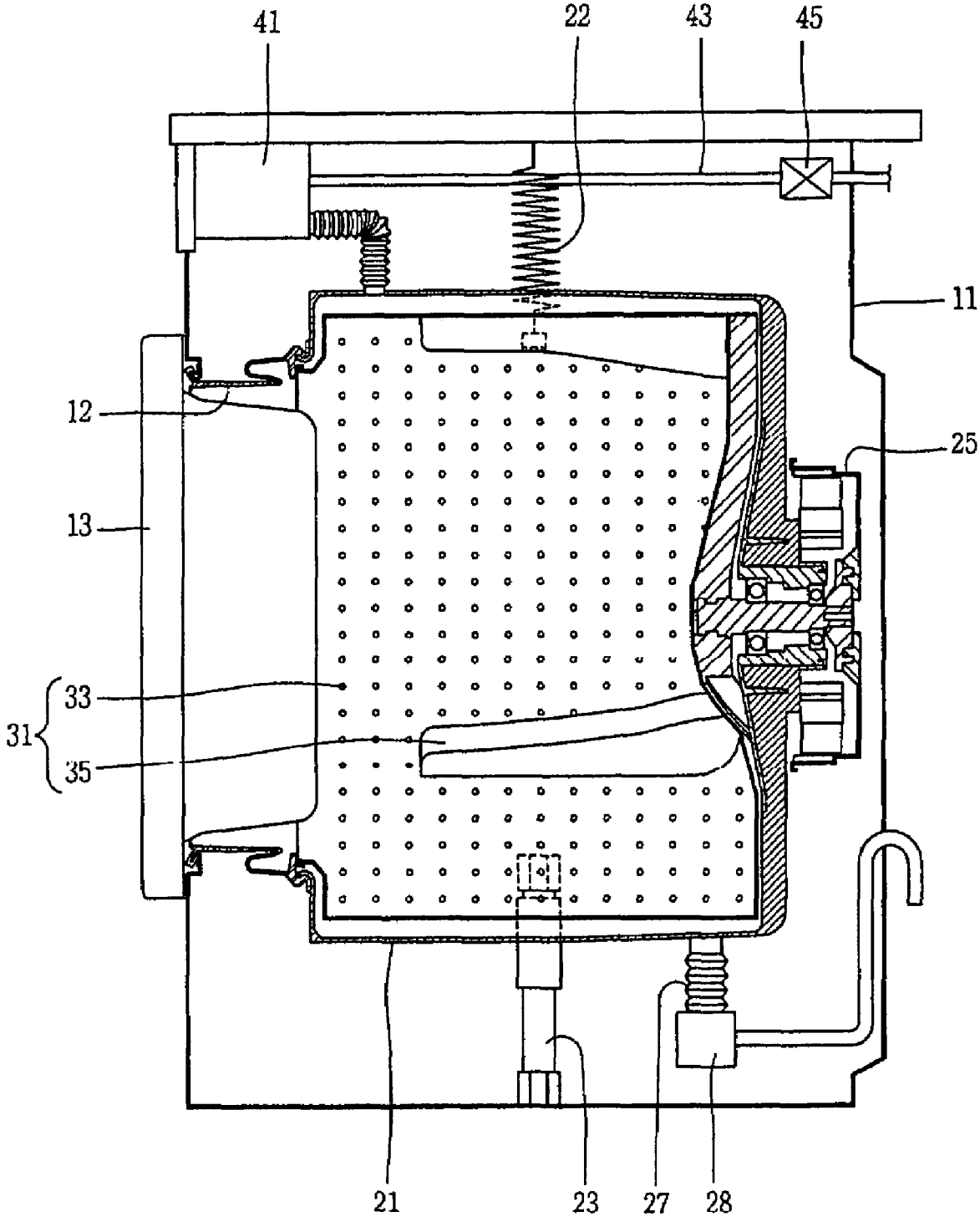
FIG. 1 is a cross-sectional view of a washing machine according to the related art.
Figure 2:
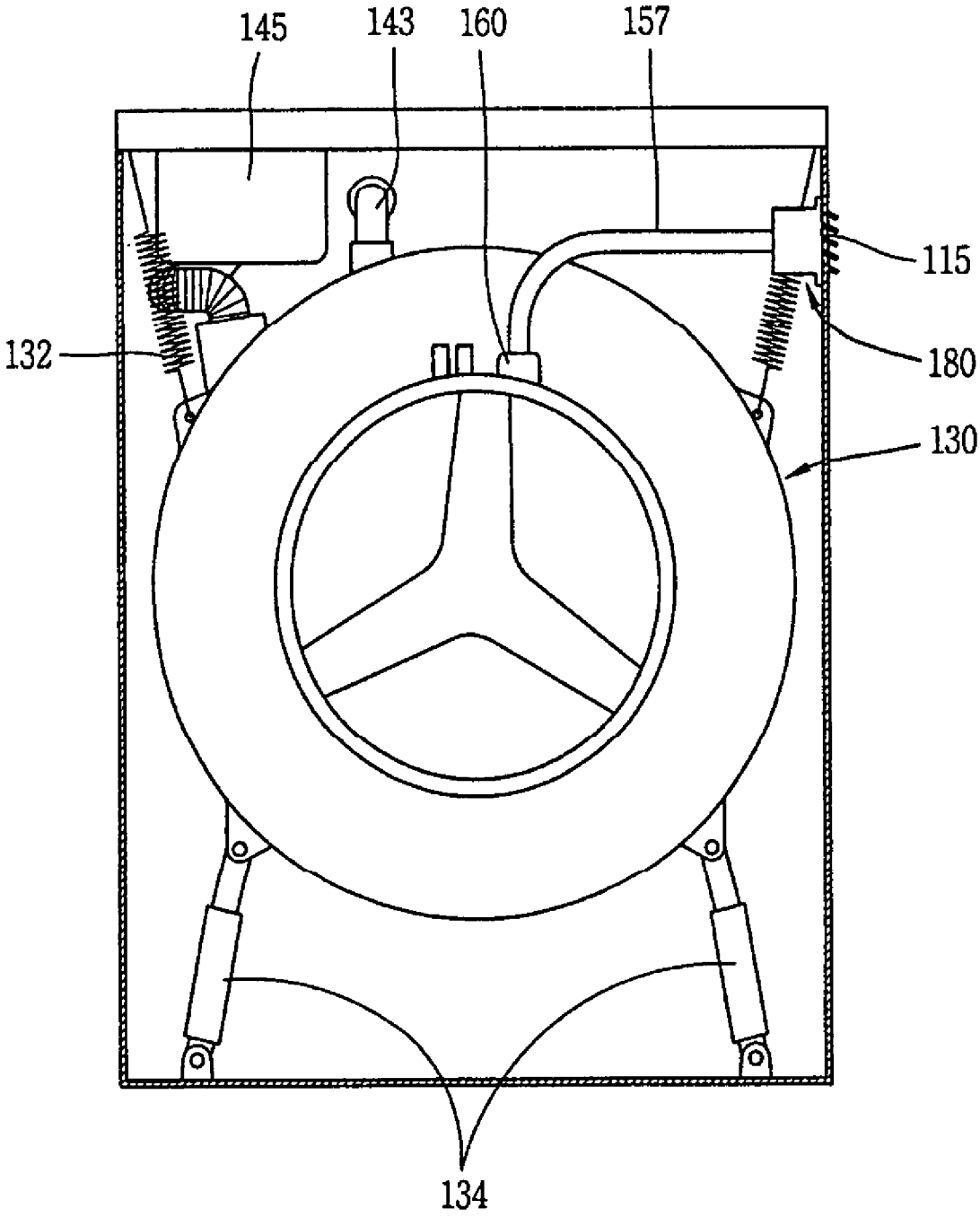
FIG. 2 is a front sectional view of a washing machine having a deodorization apparatus according to a first embodiment of the present invention.
Figure 3:
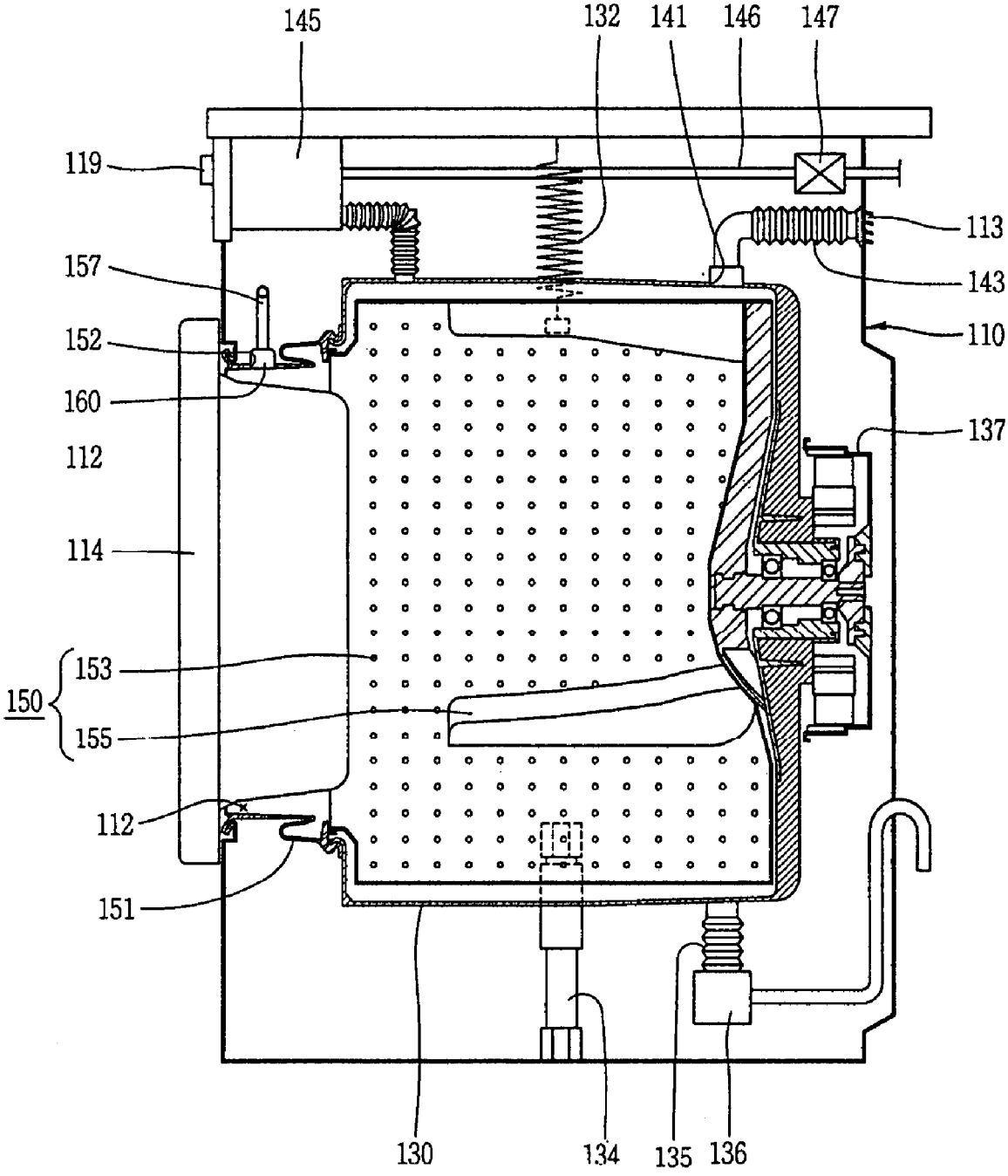
FIG. 3 is a side sectional view of a washing machine of FIG. 2.

As shown in FIGS. 2 and 3, a washing machine having a deodorization apparatus according to an embodiment of the present invention includes a cabinet 110, a tub 130 that includes a ventilator 141, and a deodorization apparatus 180 that is disposed outside the tub 130 and has one side communicating with the tub 130 so as to remove the odor of laundry by injecting the air outside the tub 130 into the tub 130.

An opening 112 and a door 114 are provided on a front surface of the cabinet 110. In the cabinet 110, the tub 130 is supported by a spring 132 and a damper 134. The tub 130 has a cylindrical shape with the front surface thereof opened. A washing tub 150 is rotatably provided in the tub 130. The washing tub 150 includes a plurality of through holes 153 and lifts 155.

A drain path 135 is formed at the bottom of the tub 130 so as to drain water. A drain pump 136 is provided on the drain path 135. A driving motor 137 is coupled to a rear end portion of the tub 130 so as to rotatably drive the washing tub 150.

A detergent dispenser 145 is provided above the tub 130 so as to dispense detergent. A water supply pipe 146 is connected to the detergent dispenser 145. A water supply valve 147 is provided on the water supply pipe 146.

A ventilator 141 is formed on a rear upper part of the tub 130 such that the inside and the outside of the tub 130 communicate with each other. A ventilating pipe 143 has one end connected to a ventilating hole 113 of the cabinet 110 so as to communicate with the outside of the cabinet 110 and the other end connected to the ventilator 141.

A gasket 151 is provided at a front of the tub 130 so as to connect the opening of the cabinet 110 and the opening of the tub 130. An intake port 152 is formed on an upper part of the gasket 151 so as to draw in air from the outside of the tub 130. A foam outflow preventing unit 160 is provided on the intake port 152 so as to prevent foam inside the tub 130 from flowing to the outside.

Figure 4:
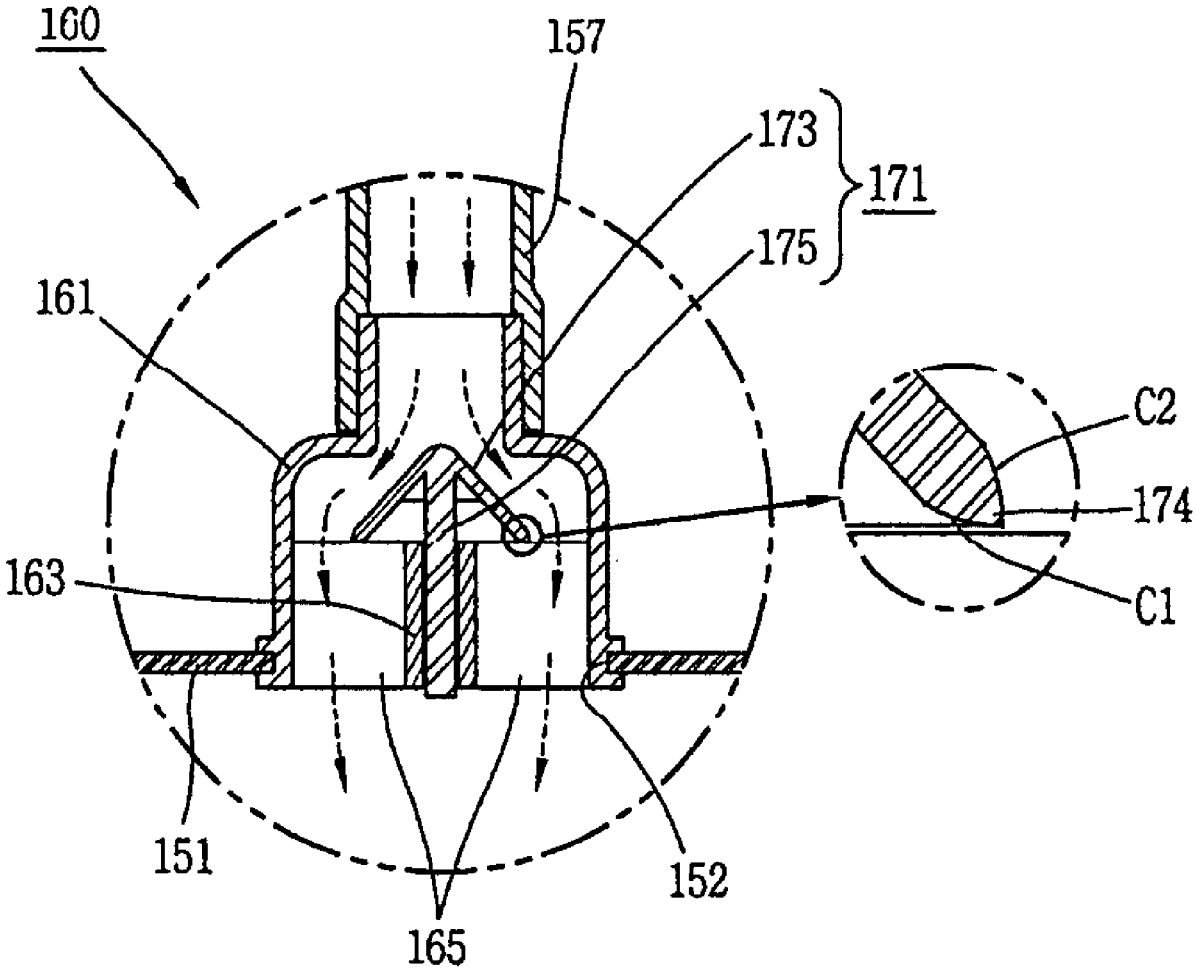
FIG. 4 is an enlarged view of a foam outflow preventing unit of FIG. 3.

As shown in FIG. 4, the foam outflow preventing unit 160 includes a housing 161 that has a flow passage therein, and a valve member 171 that opens or closes the flow passage in the housing 161. The valve member 171 includes a body 173 that has a cross section, in which a central region thereof protrudes upstream against a direction in which the air is drawn in, and a rod 175 that protrudes from the center of a lower part of the body 173. The body 173 includes an edge portion 174 that reduces flow resistance during the suction of the air and guides the foam into the center of the lower part of the body 173 during the outflow of the foam. It is preferable that the thickness of the edge portion 174 should gradually decrease toward the end thereof. The edge portion 174 has a cross section of a curve C1 that is curved downwards so as to smoothly guide the foam into the body 173 when the foam rises, and at the same time, a cross section of a curve C2 that is convex outwards so as to reduce the flow resistance of the air when the air is drawn in. Here, the edge portion 174 may have a linear cross section, or may have any one of the two curves C1 and C2. A guide portion 163 that receives the rod 175 and performs guide is formed in the housing 161. The guide portion 163 is supported by a plurality of supporting ribs 165, each of which has one end connected to the inside of the housing 161.

Figure 5:
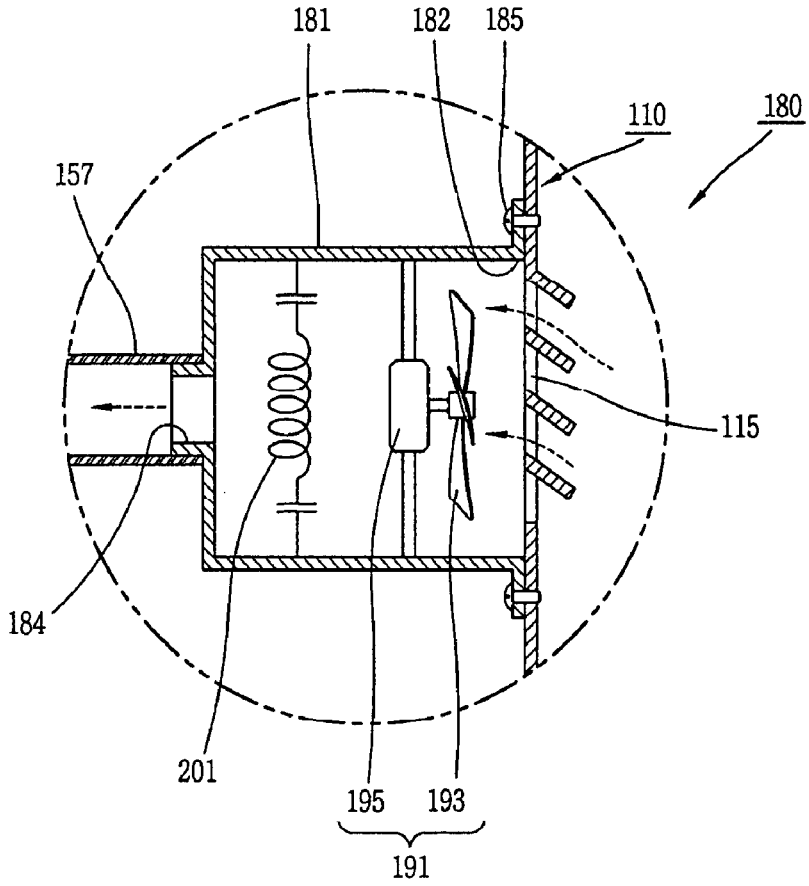
FIG. 5 is an enlarged view of a deodorization apparatus of FIG. 2.

As shown in FIG. 5, an intake port 115 is formed at one side of the cabinet 110 so as to receive the outside air. The deodorization apparatus 180 is formed at the intake port 115 so as to draw the air in. Here, it is preferable that the intake port 115 have a grill or slit structure so as to allow the air to pass therethrough and block a foreign substance with a predetermined size or more.

The deodorization apparatus 180 includes a case 181 that has an intake hole 182 for drawing the air in and a discharge hole 184 for discharging the air, a fan 191 that is disposed in the case 181, and a heater 201 that is disposed at one side of the fan 191 so as to heat the air. The fan 191 includes a rotary blade 193 having a propeller shape, and a motor 195 that rotates the rotary blade 193. A coupling portion 185 is formed on an end portion of the intake hole 182 of the case 181 so as to couple the intake hole 182 to the cabinet 110 such that the intake hole 182 communicates with the outside.

An intake pipe 157 has one end connected to the foam outflow preventing unit 160 and the other end connected to the discharge hole 184. Here, each of the fan 191 and the heater 201 has small capacity enough to supply a warm current of air (e.g., 30° C. to 40° C.) into the washing tub 150 (for example, the fan 191 has a rotation diameter in a range of 40 mm to 80 mm, and the heater 201 has an output of 200 W to 600 W). A heater controller 119 is provided outside the cabinet 110 so as to control the heat provided by the heater 201. For example, the heater controller 119 controls in such a way that the heat provided is increased when ambient air temperature is low, and the heat provided is decreased when the ambient air temperature is relatively high.

Figure 6:
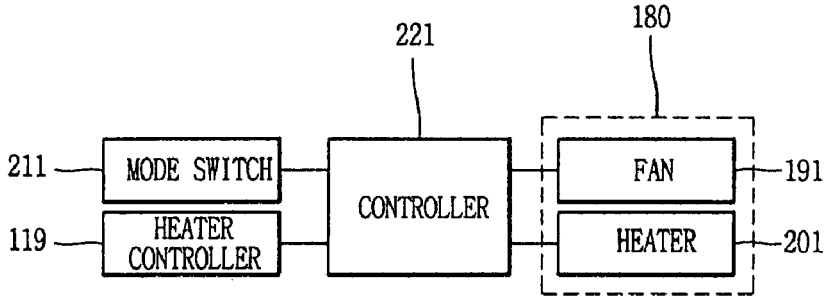
FIG. 6 is a control block diagram of a washing machine of FIG. 2.

Meanwhile, a mode switch 211 is provided outside the cabinet 110 to select a deodorization mode in which the air is injected into the washing tub 150 so as to remove the odor from the laundry inside the washing tub 150. The mode switch 211 is connected to a controller 221 such that when the deodorization mode is selected, the air is injected into the tub 130 and the laundry is agitated. The controller 221 may be implemented in the form of a microprocessor that includes a control program capable of controlling the deodorization apparatus 180 and the driving motor 137 such that when the deodorization mode is selected by the mode switch 211, the warm current of air is supplied into the tub 130 and the laundry is agitated. As shown in FIG. 6, the controller 221 is connected to and controls the heater controller 119, the deodorization apparatus 180 and the driving motor 137.

According to the above-described structure, in order to remove the odor from the laundry, the laundry is put in the washing tub 150, and the mode switch 211 is manipulated to select the deodorization mode. When the deodorization mode is selected, the controller 221 controls the power that is applied to the fan 191 and the heater 201.

When the fan 191 is driven, the air is drawn into the case 181 through the intake port 115, and the air is then heated by the heater 201. At this time, the heater 201 is operated according to a heat value controlled by the heater controller 119. The heated air flows along the intake pipe 157, passes through the foam outflow preventing unit 160, and flows into the washing tub 150 through the intake port 152. The air flowing into the washing tub 150 flows out of the washing tub 150 together with the odor of the laundry, and the air and the odor of the laundry are discharged outside the cabinet 110 through the ventilator 141 and the ventilating pipe 143.

Meanwhile, the controller 221 controls the driving motor 137 in order to agitate the laundry and rotates the washing tub 150 at a preset rotation velocity, which promotes the deodorization of the laundry.

Hereinafter, referring to FIGS. 7 to 10, a washing machine having a deodorization apparatus according to a second embodiment of the present invention will be described. Like reference numerals designate like or corresponding parts to those of the above-described or illustrated structure. Thus, the detailed description thereof will be omitted.

Figure 7:
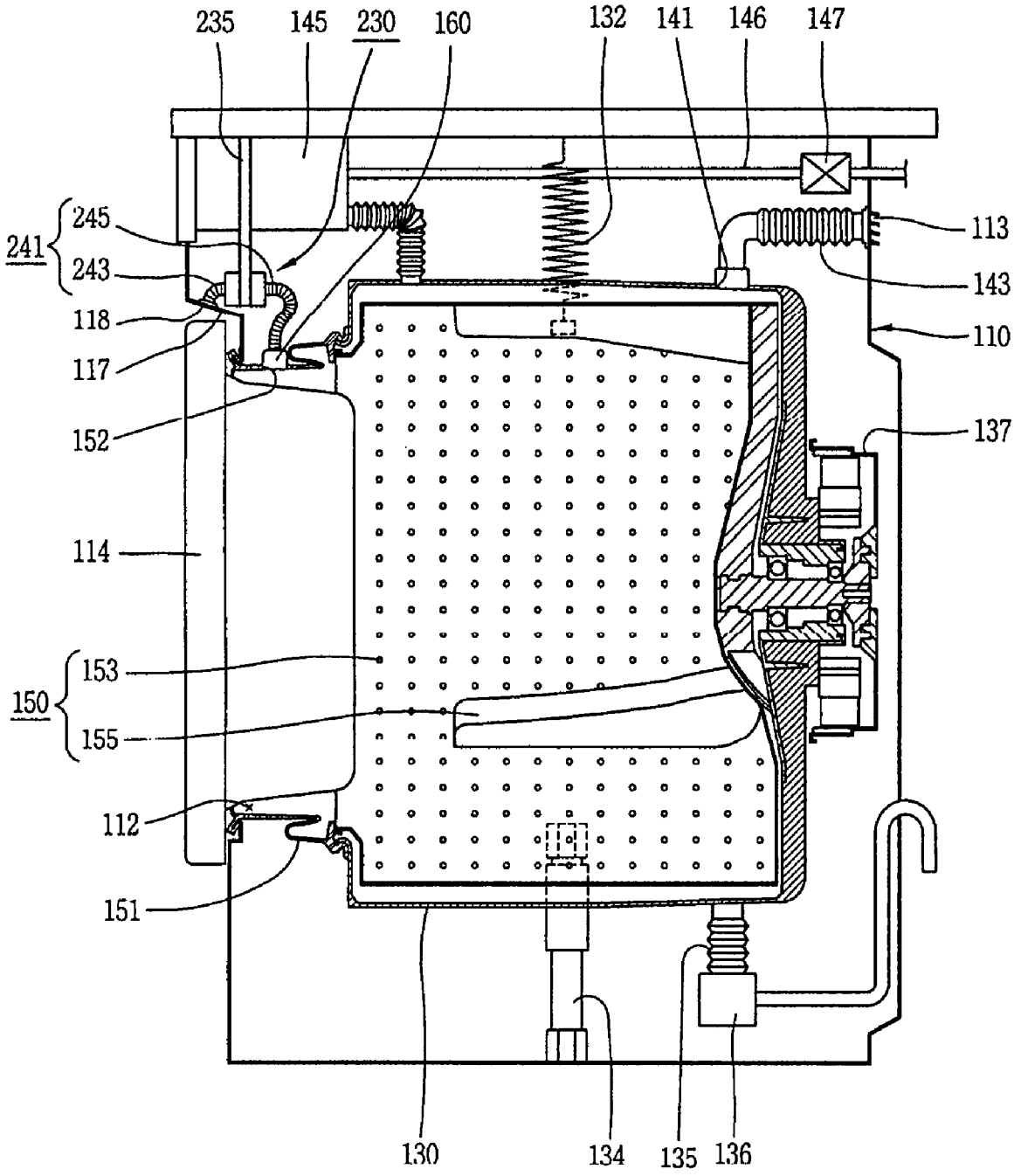
FIG. 7 is a cross-sectional view of a washing machine having a deodorization apparatus according to a second embodiment of the present invention.

As shown in FIG. 7, a washing machine having a deodorization apparatus according to a second embodiment includes a cabinet 110, a tub 130 that includes a ventilator 141, and a deodorization apparatus 230 that is disposed outside the tub 130 and has one side communicating with the tub 130 so as to remove the odor of laundry by injecting the air into the tub 130.

In the cabinet 110, the tub 130 is supported by a spring 132 and a damper 134. A washing tub 150 is rotatably received in the tub 130. The washing tub 150 includes a plurality of through holes 153 and lifts 155.

A detergent dispenser 145 is provided above the tub 130. A water supply pipe 146 is connected to the detergent dispenser 145. A water supply valve 147 is provided on the water supply pipe 146.

A ventilator 141 is formed on a rear upper part of the tub 130. A ventilating pipe 143 has one end that is connected to the ventilator hole 113 passing through the cabinet 110, and the other end connected to the ventilator 141.

Figure 8:
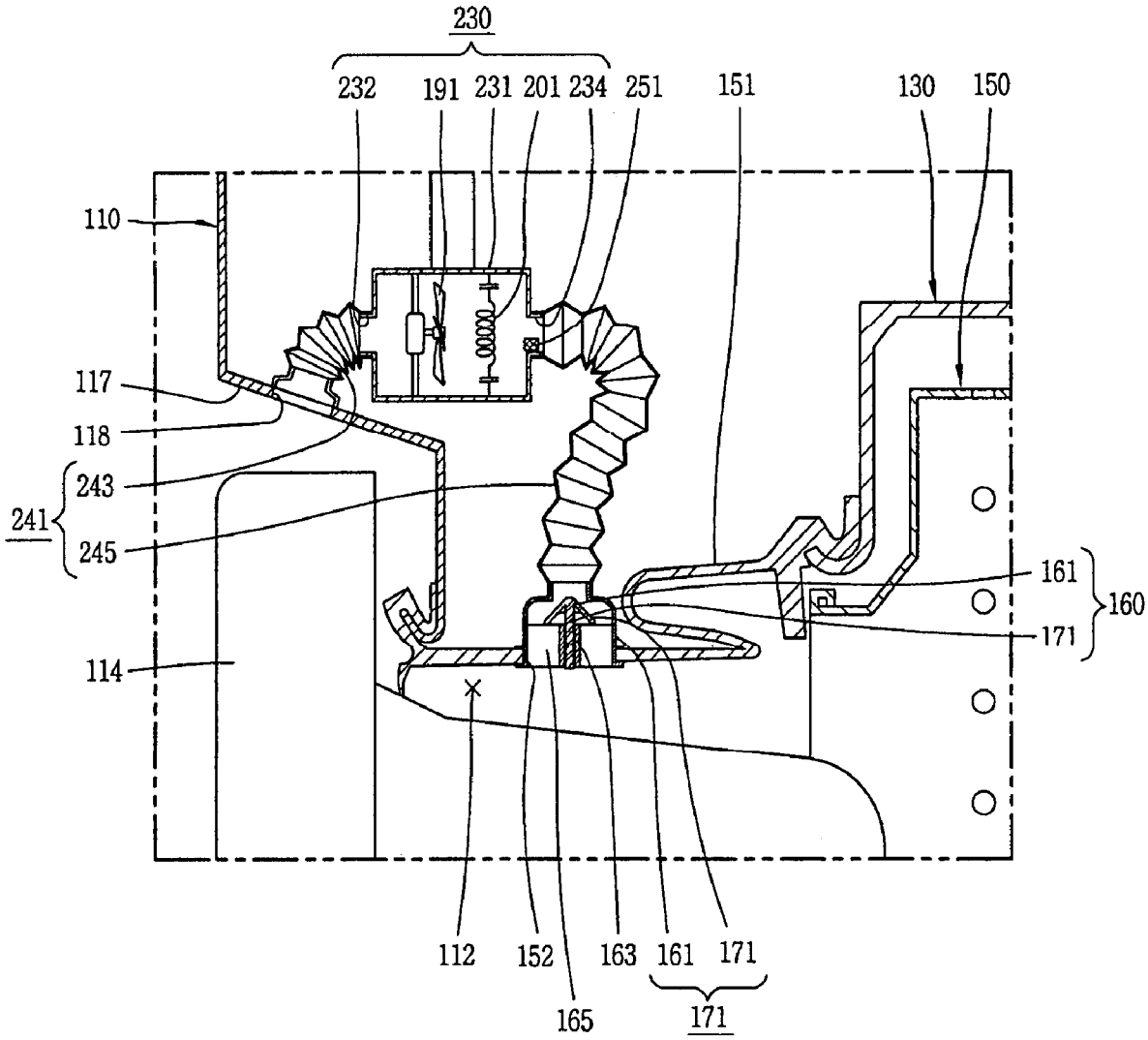
FIG. 8 is an enlarged view of a main part of FIG. 7.

As shown in FIG. 8, a gasket 151 is provided at a front surface of the tub 130, and an intake port 152 is formed on an upper part of the gasket 151. A foam outflow preventing unit 160 is provided on the intake port 152 so as to prevent foam inside the tub 130 from flowing to the outside. The foam outflow preventing unit 160 includes a housing 161 and a valve member 171 that opens or closes a flow passage in the housing 161. A guide portion 163 is formed in the housing 161 so as to guide the valve member 171. The guide portion 163 is supported by a plurality of supporting ribs 165.

Figure 9:
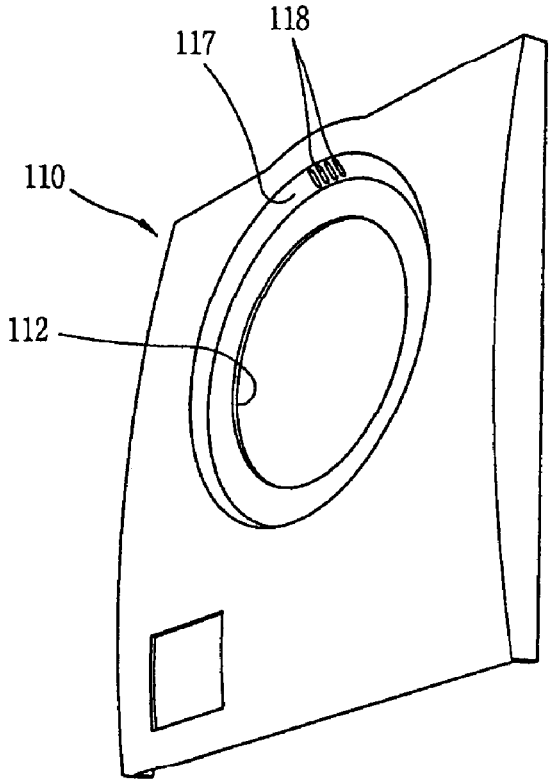
FIG. 9 is a perspective view of a front part of a washing machine of FIG. 7.

An opening 112 is formed at the front surface of the cabinet 110 so as to put the laundry in the washing tub 150 or take the laundry out of the washing tub 150. A door 114 is connected to the opening 112. As shown in FIGS. 8 and 9, a curved portion 117 that is curved inwards so as to receive one region of the door 114 is formed around an upper side of the opening 112. An intake port 118 is formed on an upper part of the curved portion 117 such that the air can be drawn into the cabinet 110.

The deodorization apparatus 230 is provided on an upper side of the gasket 151 such that the air can be injected into the tub 130. The deodorization apparatus 230 includes a case 231 that has an intake hole 182 and a discharge hole 184, a fan 191 that is disposed in the case 231, and a heater 201 that is disposed at one side of the fan 191 so as to heat the air.

An intake pipe 241 is provided at both sides of the case 231. The intake pipe 241 includes a first connecting pipe 243 that has one end connected to an intake hole 232 of the case 231 and the other end connected to the intake port 118 of the cabinet 110 and a second connecting pipe 245 that has one end connected to a discharge hole 234 of the case 231 and the other side connected to the foam outflow preventing unit 160. Here, the case 231 is supported on the cabinet 110 by a supporting member 235. The first connecting pipe 243 and the second connecting pipe 245 are composed of corrugated pipes so as to prevent vibration transmission. A temperature sensor 251 is provided downstream of the heater 201 so as to sense the temperature of the air.

Meanwhile, a mode switch 261 is provided outside the cabinet 110 to select a deodorization mode in which the air is injected into the washing tub 150 so as to remove the odor of the laundry inside the washing tub 150. Herein the deodorization mode includes an ambient air supply mode in which when the temperature of the air is relatively high, the air is not heated by the heater 201 but the air itself flows into the washing tub 150, and a warm air supply mode in which when the temperature of the air is relatively low, the air is heated by the heater 201 at set temperature (e.g. 30° C. to 40° C.) and the heated air is supplied to the washing tub 150. The warm air supply mode may be only selected when the ambient air supply mode is not selected, and the power may be only applied to the heater 201 when the temperature of the air is low. That is, when the temperature detected by the temperature sensor 251 is less than first temperature (e.g., 30° C.), the power may be applied to the heater 201, and when the temperature exceeds second temperature (e.g., 40° C.), the power may be cut off from the heater 201.

Figure 10:
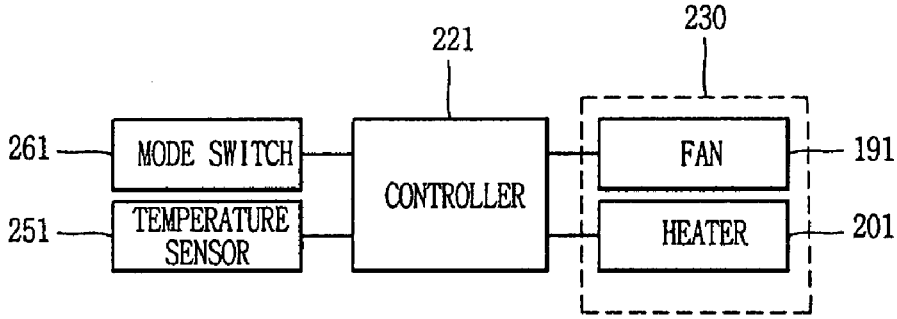
FIG. 10 is a control block diagram of a washing machine of FIG. 7.

The mode switch 261 is connected to a controller 221 such that when the deodorization mode is selected, the air is injected and the laundry is agitated. The controller 221 may be implemented in the form of a microprocessor that includes a control program. As shown in FIG. 10, the controller 221 is connected to and controls the temperature sensor 251, the fan 191 and the heater 201 of the deodorization apparatus 230, and the driving motor 137 such that the injection of the air when the deodorization mode is selected, the temperature control, and the agitation of the laundry may be smoothly performed.

According to the above-described structure, in order to remove the odor of the laundry, the laundry is put in the washing tub 150, and the mode switch 261 is manipulated to select the deodorization mode. When the ambient air supply mode is selected, the controller 221 controls the power that is applied to the fan 191. When the fan 191 rotates, the outside air is drawn in through the intake port 118 of the cabinet 110. The drawn air passes through the foam outflow preventing unit 160 and flows into the washing tub 150 through the intake port 152 of the gasket 151.

Meanwhile, when the warm air supply mode is selected, the controller 221 controls the power that is applied to each of the fan 191 and the heater 201. The air drawn into the case 231 through the intake hole 232 is heated by the heater 201, then passes through the foam outflow preventing unit 160, and flows into the washing tub 150. The controller 221 controls the heat value of the heater 201 on the basis of the detection result of the temperature sensor 251 such that the temperature of the air is maintained at the preset temperature.

The air flowing into the washing tub 150 flows out of the washing tub 150 together with the odor substance in the laundry, and the air and the odor substance of the laundry are discharged outside the cabinet 110 through the ventilator 141 and a ventilating pipe 143.

Hereinafter, the operational effect of the deodorization apparatus and a washing machine having the same according to the embodiments of the present invention will be described as follows.

According to the embodiments of the present invention, there is provided a washing machine having a deodorization apparatus capable of removing odor from the laundry more quickly as compared to when the odor of the laundry is removed by flowing the air outside the tub into the tub, and discharging the air to the outside together with the odor of the laundry.

Further, according to the embodiments of the present invention, it is possible to remove the laundry odor more quickly by continuously supplying a warm current of air to the laundry.

Further, according to the embodiments of the present invention, it is possible to reduce water and power consumption because a washing operation using water only for deodorization of the laundry is not needed, and to prevent damage to the laundry and a decreased laundry life which that are caused by the washing operation using the water.

Further, according to the embodiments of the present invention, it is possible to reduce noise generation and power consumption that are caused by driving the washing tub because the washing tub does not need to be continuously rotated but intermittently rotated for agitation of the laundry if necessary.

Further, according to the embodiments of the present invention, there is provided a washing machine having a deodorization apparatus simply mounted on the tub of the existing washing machine and capable of removing laundry odor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A washing machine having a deodorization apparatus, comprising:

a cabinet;

a tub including a ventilator;

a deodorization apparatus disposed outside the tub, having one side that communicates with the tub, and removes laundry odor by injecting air into the tub, wherein the deodorization apparatus includes a fan that promotes the flow of the air and a heater that is disposed at one side of the fan; and a foam outflow preventing unit that prevents foam inside the tub from flowing to the outside is provided at a discharge side of the deodorization apparatus, wherein the foam outflow preventing unit includes a housing that has an air passage therein and a valve member that is movably disposed in the housing so as to open or close the air passage.

2. The washing machine having a deodorization apparatus of claim 1, further comprising:

a case that has an intake hole and a discharge hole and accommodates the fan and the heater therein.

3. The washing machine having a deodorization apparatus of claim 1, wherein the other side of the deodorization apparatus communicates with the outside of the cabinet.

4. The washing machine having a deodorization apparatus of claim 3, wherein an intake port is formed at one side of the cabinet and communicates with the outside, and the deodorization apparatus is formed on the intake port.

5. The washing machine having a deodorization apparatus of claim 3, wherein an intake port is formed on a front surface of the cabinet and communicates with the outside.

6. The washing machine having a deodorization apparatus of claim 5, wherein the cabinet includes an opening and a door through which laundry is put in and taken out of the cabinet, and the intake port is opened downwards on the cabinet such that the intake port is disposed at an upper part of the door.

7. The washing machine having a deodorization apparatus of claim 1, wherein a gasket is provided at a front surface of the tub and the discharge side of the deodorization apparatus communicates with the gasket.

8. The washing machine having a deodorization apparatus of claim 1, wherein the valve member includes an edge portion that has a central portion, which protrudes upstream against the flow direction of the drawn air and has a thickness that gradually decreases.

9. The washing machine having a deodorization apparatus of claim 1, further comprising:

a washing tub rotatably provided in the tub;

a driving motor provided at the outside of the tub so as to rotate the washing tub;

a mode switch selecting any one of a plurality of operating modes including a deodorization mode in which the laundry inside the washing tub is agitated and the air is supplied in the tub so as to remove the odor of the laundry; and a controller controlling the deodorization apparatus and the driving motor when the deodorization mode is selected by the mode switch.

10. The washing machine having a deodorization apparatus of claim 1, further comprising:

a washing tub rotatably provided in the tub;

a driving motor provided at the outside of the tub so as to rotate the washing tub;

a mode switch selecting any one of a plurality of operating modes including a deodorization mode in which the laundry inside the washing tub is agitated and ambient air or warm air is supplied in the tub so as to remove the odor of the laundry; and a controller controlling the deodorization apparatus and the driving motor when the deodorization mode is selected by the mode switch.

11. The washing machine having a deodorization apparatus of claim 10, wherein the deodorization mode includes an ambient air supply mode in which ambient air is supplied and a warm air supply mode in which warm air is supplied, and the controller controls the fan to rotate in the ambient air supply mode and controls the fan and the heater in the warm air supply mode.

12. The washing machine having a deodorization apparatus of claim 10, wherein the deodorization apparatus further includes a temperature sensor that is disposed downstream of the heater so as to sense the temperature of the air and the controller controls the heater based upon the temperature sensor.

13. The washing machine having deodorization apparatus of claim 1, further comprising a heater controller provided outside of the cabinet that controls a heat value of the heater based on the ambient air temperature.

14. A deodorization apparatus comprising:

a case including an intake hole and a discharge hole;

a fan disposed in the case;

a heater disposed in the case;

a connecting pipe connected to at least one of the intake hole and the discharge hole; and a foam outflow preventing unit that prevents foam inside a tub of a washing machine from flowing to the outside is provided at a discharge side of the deodorization apparatus, wherein the deodorization apparatus is installed in the washing machine and the foam outflow preventing unit includes a housing that has an air passage therein and a valve member that is movably disposed in the housing so as to open or close the air passage.

15. The deodorization apparatus of claim 14, wherein a coupling portion is formed on the intake hole such that the intake hole is coupled to a targeted object.

16. The deodorization apparatus of claim 14, wherein the connecting pipe includes a first connecting pipe and a second connecting pipe that are connected to the intake hole and the discharge hole, respectively.

* * * * *